US005198030A

United States Patent [19]

Franke

[11] Patent Number: 5,198,030

[45] Date of Patent: Mar. 30, 1993

[54] BEAD EDGE GUIDE FOR USE IN SLIDE-BEAD COATING

[75] Inventor: Mark D. Franke, Greenville, S.C.

[73] Assignee: E. I. Du Pont de Nemours and Company, Wilmington, Del.

[21] Appl. No.: 717,233

[22] Filed: Jun. 18, 1991

[51] Int. Cl.[5] ..... B05C 3/00

[52] U.S. Cl. ..... 118/411; 118/DIG. 2; 118/412

[58] Field of Search ..... 118/412, 413, 406, 419, 118/DIG. 2, DIG. 4, 491; 427/402, 420

[56] References Cited

U.S. PATENT DOCUMENTS 3,413,143 11/1968 Cameron et al. ..... 118/410
3,508,947 4/1970 Hughes .
3,526,536 9/1970 Spengos et al. .
3,632,403 12/1969 Greiller .
3,968,772 7/1976 Greiller .
4,135,477 1/1979 Ridley .
4,297,396 10/1981 Takehara et al. .

*Primary Examiner*—W. Gary Jones
*Assistant Examiner*—Brenda Lamb

[57] ABSTRACT

An apparatus for controlling the bead edge in slide-bead coating is dislcosed employing bead edge guides in a gap between a coating lip and a moving substrate. The apparatus provides for improved coating quality and less material loss typically observed with increased line speeds.

9 Claims, 3 Drawing Sheets

BEAD EDGE GUIDE FOR USE IN SLIDE-BEAD COATING

FIELD OF INVENTION

This invention relates to a method for simultaneously coating a plurality of liquid layers onto a moving substrate. This invention relates particularly to improvements in coating quality due to improved stability in flow dynamics of edges of the plurality of layers during slide-bead coating.

BACKGROUND OF THE INVENTION

Several methods of coating flowing liquids or a plurality of liquids are known in the art with the two most common types being curtain coating and slide-bead coating. Curtain coating has the disadvantage of requiring a free flowing curtain of solution which must be carefully controlled and monitored for uniformity across the substrate such as illustrated in U.S. Pat. No. 4,135,477 and references sited therein. Slide-bead coating is known in the art to provide a means of supplying a plurality of liquids to a coating efflux surface in which a bead is formed in a gap between a moving substrate and a lip of the coating efflux surface. The bead is normally maintained by differential pressure between the top of the flowing liquid and the bottom of the flowing liquid. The bead typically and preferable extends the width of the coating efflux surface (i.e. perpendicular to the direction of liquid flow) with the bead edge defined by an edge guide which is attached to the efflux surface. The edge guide acts as a physical barrier to control the width of liquid flowing onto the moving substrate.

The outer boundaries of the plurality of liquids are not controlled in the gap region between the coating lip on the coating efflux surface and the moving substrate. Variations in the bead tend to propagate at the bead edge thereby disrupting the integrity of the bead causing coating defects. An increase in differential pressure is typically required to maintain the integrity of the bead, however, higher differential pressure tends to cause other defects such as comb marks and streaks, for example. Improving the stability of the bead edge allows for the use of lower differential pressure thereby guarding against other defects while still maintaining a stable bead. The loss of bead integrity is a major cause for the loss of material which is unsuitable for the end use. This effect is more pronounced as the coating speed is increased.

The disclosed invention demonstrates a means for establishing and maintaining the bead edge by the use of an improved bead edge guide.

SUMMARY OF INVENTION

It is an object of this invention to provide a means for slide bead coating with improved stability in a liquid bead edge in a gap region between a coating efflux surface and a moving substrate. This and other objects are achieved with an apparatus for coating a moving substrate with simultaneous application to the substrate of a plurality of layers of flowing liquid comprising a drive mechanism for moving said substrate at a desired speed, a coating efflux means having a surface with a coating lip at a terminus of said coating efflux surface, a mechanism for supplying a plurality of said flowing liquids to said coating efflux surface and said coating lip allowing the plurality of liquids to traverse a gap between said coating lip and said moving substrate, means for applying differential pressure to a top and a bottom of said flowing solution thereby forming a bead within said gap, edge guides located on edges of said coating efflux surface capable of controlling a width of said flowing liquid on said coating efflux surface wherein the improvement comprises a bead edge guide positioned in the gap between said coating lip and said moving substrate with the edge guide contacting an edge portion of the flowing solution traversing the gap prior to coating the moving substrate.

DETAILED DESCRIPTION OF THE INVENTION

Throughout the following detailed description, similar referenced characters refer to similar elements in all figures of the drawings.

Figure 1:
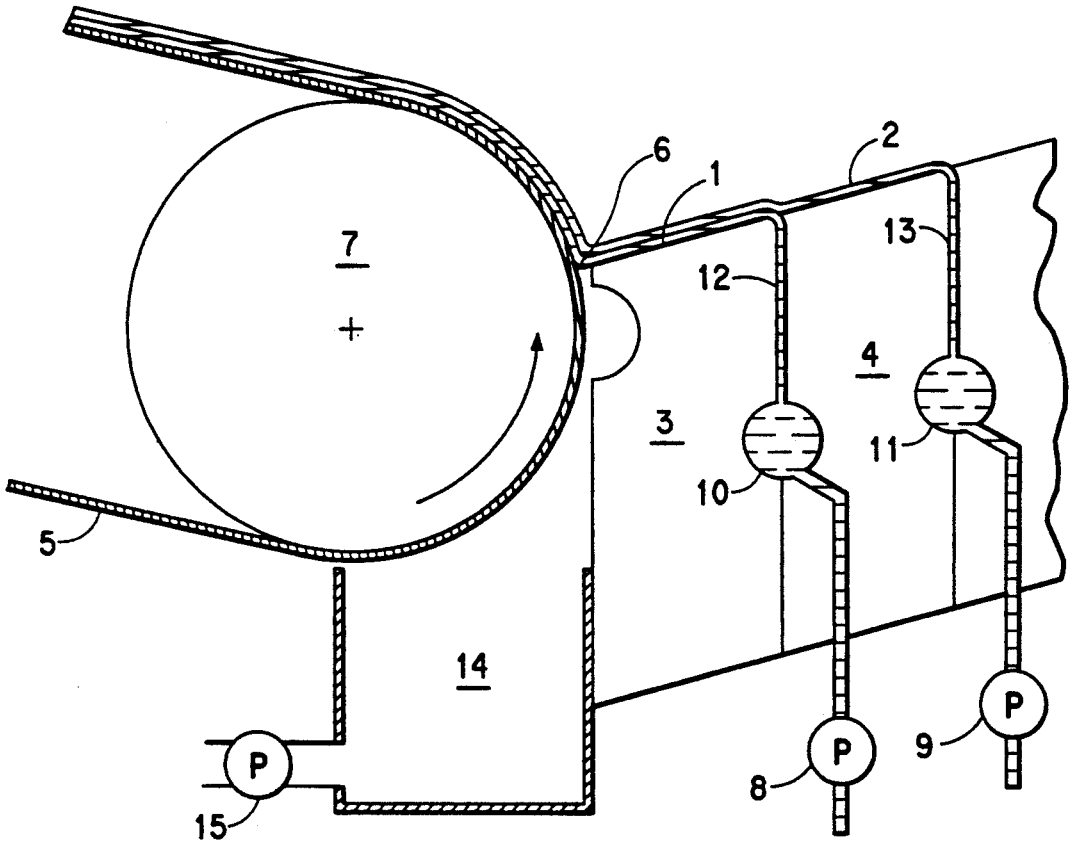
FIG. 1 is a side view of a conventional slide bead coating apparatus.

A side view of a conventional slide bead coating apparatus is contained in FIG. 1. In FIG. 1, the solutions to be coated, as illustrated by 1 and 2, are supplied to slide type hopper coating heads 3 and 4 and applied to a substrate 5 thereby forming a bead 6. The substrate to be coated 5 is conveyed by a roller 7. Coating solution is supplied by an appropriate number of supply pumps 8 and 9 which feed into cavities 10 and 11 and slots 12 and 13. A chamber 14, and associated pump 15, is adapted to reduce the pressure on the lower portion of the bead 6 (as viewed in FIG. 1).

Figure 2:
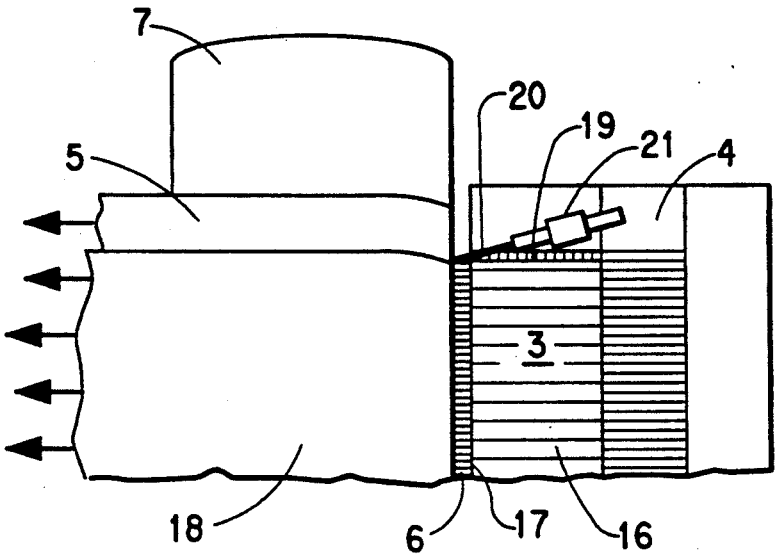
FIG. 2 is a partial top view of a conventional slide bead coating apparatus but additionally showing the location of one bead edge guide of the present invention.

FIG. 2 illustrates the position of one embodiment of the present invention and its proximity to the coating head, substrate being coated and conventional edge guide. In FIG. 2, the solutions being coated, represented collectively as 16, flow from the slide type coating head 3 and 4 forming a bead 6 between the coating lip 17 and the substrate 5 creating a coated substrate 18. The edge of the coating solution is physically constrained on the coating efflux surface adjacent the coating lip by a standard efflux edge guide 19 which extends to the coating lip 17. In contact with the edge of the bead is one preferred bead edge guide of the present invention represented as 20. The bead edge guide 20 of the present invention is situated in the gap between the coating lip 17 and the moving substrate 5 on roll 7 and represents a physical barrier for control of the bead edge in the critical region between the coating lip 17 and the moving substrate 5. A mounting bracket 21 connects the bead edge guide to the efflux edge guide 19. This preferred mounting method is advantageous since the conventional efflux edge guide and bead edge guide can be removed simultaneously for cleaning without changing the relative orientation between the two types of edge guides. The bead edge guide may also be mounted in any other fashion consistent with the overall operation of the coating apparatus such as, for example, the coating efflux surface, the side of the coating head, the roller cradle or any other location which does not interfere with the solution flow. The mounting bracket 21 may be secured to the bead edge guide using any standard method, including but not limited to screws, glue and straps.

Figure 3:
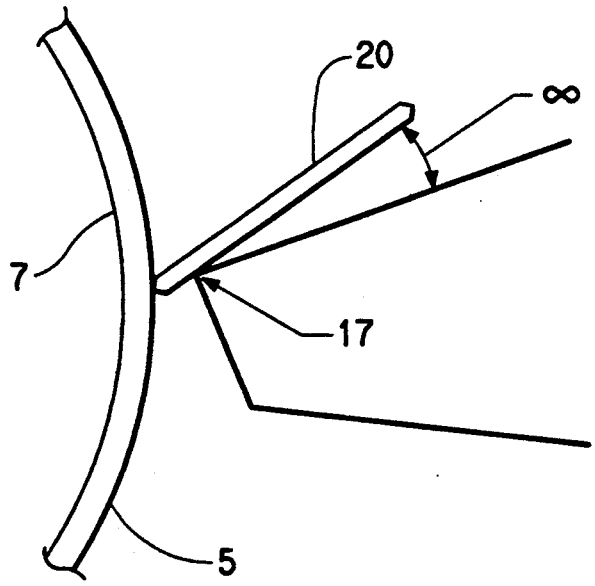
FIG. 3 is a partial schematic side view of a slide bead coater showing one embodiment of the location of one bead edge guide of the present invention.

FIG. 3 illustrates a schematic side view encompassing the present invention. For clarity the solution being coated is not shown in this illustration. The angle illustrated as (alpha) is an angle between the face of the coating efflux surface 21 and the bead edge guide 20 (from a side view) and the angle is chosen based on the coating speed, the differential pressure applied to the bead and the viscosity of the coating solution. In general, the angle (alpha) will be adjusted as the above mentioned parameters are varied to draw the bead into the gap region extending to substitute 5 on roll 7. For example, at a fixed coating speed the angle (alpha) will, in general, increase with increasing differential pressure. For a fixed differential pressure the angle (alpha) will, in general, decrease with increasing line speed.

Figure 4:
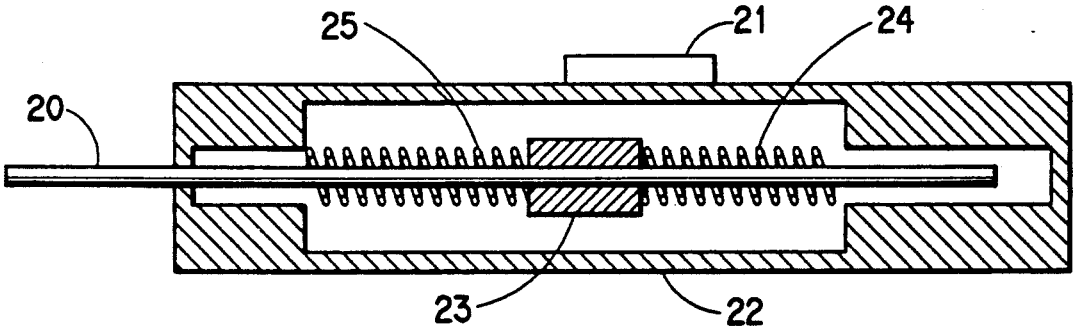
FIG. 4 is a schematic representation of a preferred bead edge guide embodiment.

A detailed description of the preferred embodiment of the present invention is illustrated in FIG. 4. In FIG. 4, the bead edge guide 20 includes a rod-like member in an encasement 22. The rod-like member has a sleeve 23 which is positioned between tension provision devices 24 and 25 within an encasement 22. The bead edge guide 20 may be prepared from a myriad of materials, including but not limited to, wood, plastic, polymeric materials, or combinations thereof. The encasement 22 provides a means for containing said tension provision devices 24 and 25 and any material or shape may be mentioned provided a means is provided for securing the present invention to the said coating apparatus or coating apparatus support. The sleeve 23 is to provide a dual purpose, one being to secure said rod-like contacting element 20 within the casing 22 and one being to provide a means for adjustment of the bead edge guide along the long axis to maintain the best operability. As such, sleeve 23 may be considered, in one embodiment, to be part of the contacting element 20 or may be a separate element. Tension provision elements 24 and 25 are adjusted such that the bead edge guide 20 remains within the gap region between the substrate and the coating lip during the coating process but are also to provide flexibility to protect the end of the contacting element in the event of any abnormality in the coating process which would cause the bead edge guide to retreat into the casing and away from the substrate until the abnormality ceases. A mounting bracket 21 attaches to the encasement to provide a means for fastening the encasement 22 to the coating apparatus.

The invention described herein may be mentioned for amyriad of flowing liquids. Preferred are photosensitive and or radiation sensitive layers.

The photosensitive and/or radiation sensitive layers useful with the present invention may be any which are well-known for imaging and reproduction in fields such as graphic arts, printing, medical and information systems. Silver halide photosensitive layers and their associated layers are preferred. Photopolymer, diazo, vesicular image-forming compositions and other systems may be used in addition to silver halide.

The film support for the emulsion layers used in the novel process may be any suitable transparent plastic or paper. Examples of suitable plastics include, but are not limited to, cellulosic supports, e.g. cellulose acetate, cellulose triacetate, cellulose mixed esters, polyethylene terephthalate/isophthalates and the like. The above polyester films are particularly suitable because of their dimensional stability. During the manufacture of the film it is preferable to apply a resin subbing layer such as, for example, the mixed-polymer subbing compositions of vinylidene chloride-itaconic acid, taught by Rawlins in U.S. Pat. No. 3,567,452 or antistatic compositions as taught by Miller U.S. Pat. Nos. 4,916,011 and 4,701,403 and Cho U.S. Pat. No. 4,891,308.

The application of multiple layers may employ coating hoppers such as have been summarized in Research Disclosure, No. 308, Dec. 1989, Item 308119.

The coated element of a photographic film is dryed by liquid medium evaporation. The evaporation is preferably accelerated by conduction, convection and/or radiation heating. Heat transfer can occur through the support such as by physical contact with a heated drum or roller or by direct contact with a gaseous medium such as warm air, as illustrated by Van Derhoef, et. al. U.S. Pat. No. 2,269,169, Rose U.S. Pat. No. 2,620,285 and Ruff German OLS 2,703,776 and Arter, et. al. U.S. Pat. No. 4,365,423. Jet impingement of the coated layers with a gaseous medium provides both a heat and mass transfer medium as illustrated by Willis U.S. Pat. No. 1,951,004, Allander et. al. U.S. Pat. No. 3,012,335, Meier-Windhorst U.S. Pat. No. 3,041,739, Stelling U.S. Pat. No. 3,074,179, Darcy et. al. U.S. Pat. No. 3,599,341 and Stibbe U.S. Pat. No. 4,116,620. Radiation to which the photographic element is relatively insensitive can be used to facilitate liquid medium evaporation as illustrated by Beck U.S. Pat. Nos. 2,815,307 and 2,898,882, and microwave heating, as illustrated by Dippel et. al. U.S. Pat. No. 2,588,218, Cunningham et.al. U.S. Pat. No. 2,662,302, Bleackley U.S. Pat. No. 3,466,415, Hering U.S. Pat. No. 3,589,022, Stephansen U.S. Pat. No. 3,672,066, Philips U.K. Patent 633,731 and Kuroki et. al. U.K. Patent 1,207,222.

The application of this invention can best be described by the example given below which are not intended to limit the claims of the invention.

EXAMPLE

A standard medical x-ray emulsion was prepared with conventional silver bromide grains dispersed in a 107 grams of photographic grade gelatin per mole of silver bromide. Water was added to dilute the dispersion to 10% in silver bromide. Chemical sensitization and stabilization was accomplished using techniques well known in the art as exemplified in LeStrange, U.S. Pat. No. 4,965,184. The resulting viscosity was 10 cp. The emulsion was coated with a thin stratum of gelatin coated supra thereto on a polyethelene terephalate substrate. A coating width of 14 cm was used. Coatings were accomplished on a pilot scale coater equipped with the ability to alter the differential pressure between the top of the flowing solution and the bottom of the coating solution in the gap between the moving substrate and the coating lip employing apparatus such as shown in FIGS. 1 to 4 except as a control on edge bead guide of the present invention. The gap was set at 10 mil throughout the operation. The minimum differential pressure required to maintain a coating bead was monitored and reported the results of which are in Table 1.

TABLE 1

EFFECT OF BEAK EDGE GUIDE ON MINIMUM DIFFERENTIAL PRESSURE (inches of water).

| Line Speed M/Minute | Solution Flow ml/Minute | Minimum Differential Pressure With BEG | Without BEG |
|---|---|---|---|
| 122 | 992 | 0.20 | 0.40 |
| 152 | 992 | 0.30 | 0.55 |
| 152 | 1240 | 0.25 | 0.50 |
| 183 | 1240 | 0.45 | 0.80 |

M is meters
BEG is bead edge guide

This Table indicates that the bead edge guide permits a lower differential pressure to be employed in the coating procedure. As differential pressure is increased, a greater propensity for coating defects is introduced.

What is claimed is:

1. In a slide bead coating apparatus for coating a moving substrate with a plurality of layers of flowing liquids comprising a drive mechanism for moving said substrate at a desired speed, a coating efflux means having a surface with a coating lip at a terminus of said coating efflux surface, a mechanism for supplying a plurality of said flowing liquids to said coating efflux surface and said coating lip allowing the plurality of liquids to traverse a gap between said coating lip and said moving substrate, means for applying differential pressure to a top and a bottom of said flowing liquids thereby forming a bead within said gap, edge guides located on edges of said coating efflux surface capable of controlling a width of said flowing liquid on said coating efflux surface wherein the improvement comprises a bead edge guide positioned in the gap between said coating lip and said moving substrate with the edge guides contacting only a lateral edge portion of the flowing liquids traversing the gap prior to coating the moving substrate.

2. An apparatus of claim 1 wherein two of said bead edge guides are positioned in the gap on opposite edge portions of the flowing liquids.

3. An apparatus of claim 2 wherein said bead edge guides are attached to said efflux edge guides.

4. An apparatus of claim 2 wherein said bead edge guides are constructed of a polymeric material.

5. An apparatus of claim 2 wherein said bead edge guides are constructed of wood.

6. An apparatus of claim 1 wherein said bead edge guide comprises a casing element, tension provision elements within said casing element, a sleeve between said tension provision elements and a bead edge guide element protruding through said sleeve and beyond the confines of said casing.

7. An apparatus of claim 6 wherein said tension provision elements are springs.

8. An apparatus of claim 6 wherein said bead edge guide is selectively movable along the longitudinal axis within said sleeve.

9. An apparatus of claim 6 wherein said bead edge guide element and said sleeve represent one element.

* * * * *